United States Patent [19]

Foffel

[11] 4,406,647

[45] Sep. 27, 1983

[54] METHOD OF MAKING, INSERTING, AND REMOVING ENVELOPE INSERTS FOR MAGAZINES

[75] Inventor: John F. Foffel, St. Charles, Ill.

[73] Assignee: Berlin Industries, Addison, Ill.

[21] Appl. No.: 288,193

[22] Filed: Jul. 29, 1981

Related U.S. Application Data

[62] Division of Ser. No. 149,851, May 14, 1980, Pat. No. 4,313,557.

[51] Int. Cl.[3] ..... B31B 41/00

[52] U.S. Cl. ..... 493/216; 493/921

[58] Field of Search ..... 493/216, 921; 229/73, 229/69, 68 R; 283/1 B; 282/25; 53/46 D, 206

[56] References Cited

U.S. PATENT DOCUMENTS

| | | | |
|---|---|---|---|
| 3,062,431 | 11/1962 | Rabenold | 229/73 |
| 3,369,732 | 2/1968 | Hanson | 229/68 R |
| 3,411,699 | 11/1968 | Pine et al. | 229/73 X |
| 3,560,025 | 2/1971 | Ostrander | 229/68 R X |
| 3,952,942 | 4/1976 | O'Leary et al. | 229/73 X |
| 4,055,294 | 10/1977 | Traise | 229/73 X |

*Primary Examiner*—James F. Coan

[57] ABSTRACT

An envelope insert for a magazine has a uniform double thickness of sheet material throughout so that a plurality of envelope inserts can be stacked evenly for automatic insertion into magazines. The envelope insert is comprised of substantially coextensive first and second sheets which have superposed edges. The first sheet has a perforation line which is spaced from the end of the first sheet, and the second sheet has a perforation line which is located between the end of the sheet and the perforation line of the first sheet to provide a flap portion on the first sheet between the perforation line of the first sheet and the perforation line of the second sheet. The flap portion is provided with adhesive so that it can be folded over the second sheet and secured thereto after the sheets are torn along the perforation lines.

3 Claims, 12 Drawing Figures

METHOD OF MAKING, INSERTING, AND REMOVING ENVELOPE INSERTS FOR MAGAZINES

This application is a division of application Ser. No. 149,851, now U.S. Pat. No. 4,313,557, filed May 14, 1980.

BACKGROUND AND SUMMARY

This invention relates to an envelope which is to be inserted into a magazine.

Magazines frequently include tear-out envelope inserts which the reader can use to send money, entry blanks, or the like to advertisers. For example, an advertiser might offer an introductory sample of a product for one dollar. The reader is instructed to tear out an envelope which is associated with the advertisement, enclose a dollar in the envelope, and mail the envelope to the advertiser.

Such envelopes are usually bound into the magazine by an attaching portion which is an extension of one of the sheets of the envelope and which is inserted between two pages of the magazine as the magazine is being assembled and bound. The envelope is joined to the attaching portion by a perforation line or tear line, and the attaching portion remains bound into the magazine when the envelope is torn off.

It is advantageous to stack a plurality of such envelopes and feed the envelopes between the pages of successive magazines automatically. However, the attaching portion has a single thickness of material whereas the envelope has a double thickness of material. A stack of envelopes therefore has a tendency to slant or tilt toward the end where the attaching portion is located, and the unevenness of the stack causes problems in machine-feeding the envelopes. As a result, magazine publishers ordinarily charge advertisers a substantial premium for binding envelopes into magazines.

Envelope inserts formed in accordance with the invention have a uniform double thickness of sheet material throughout the insert so that a plurality of envelopes can be stacked evenly. This enables the envelope to be machine fed easily and substantially reduces the time and cost of binding the envelopes into magazines. The portion of the insert which is bound into the magazine can be provided by both sheets of the insert by offsetting the tear-off perforation lines in the two sheets. The offset perforation lines provide a flap portion on one of the sheets when the envelope is separated from the portion of the insert which remains bound into the magazine. The flap portion is provided with adhesive so that the flap portion can be folded over the other sheet and secured thereto to seal the envelope.

DESCRIPTION OF THE DRAWINGS

The invention will be explained in conjunction with illustrative embodiments shown in the accompanying drawing, in which.

DESCRIPTION OF THE SPECIFIC EMBODIMENTS

Figure 1:
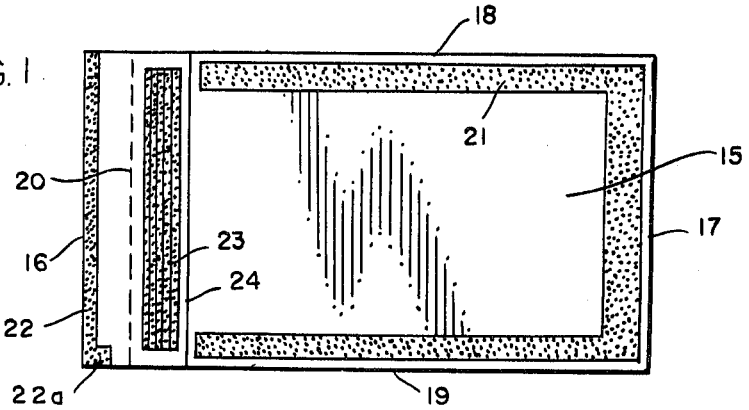
FIG. 1 is a top plan view of one of the sheets of an envelope insert formed in accordance with the invention.

Referring first to FIG. 1, a rectangualr sheet 15 of paper or equivalent stock for making envelopes has a pair of end edges 16 and 17 and a pair of elongated side edges 18 and 19. A perforation line or tear line 20 is formed in the sheet spaced from the end edge 16 and parallel thereto. As used in this description and in the claims, the words "perforation line" are intended to include perforations, score lines, lines of weakness, or any equivlent means for facilitating tearing or detaching of the sheet material along an intended line.

A U-shaped bar of adhesive 21 is applied to the sheet adjacent the edges 17–19, and a thinner bar of adhesive 22 is applied adjacent the end edge 16. The ends of the U-shaped adhesive bar are spaced inwardly from the perforation line 20, and an adhesive bar 23 is applied to the sheet between the perforation line and the ends of the U-shaped adhesive bar.

The adhesive bar 23 is remoistenable adhesive, which is well known in the art. The remoistenable adhesive is dried before the second sheet of the envelope is applied so that the second sheet will not stick to the remoistenable adhesive. The adhesive bars 21 and 22 are wet adhesive so that the second sheet will be secured to the first sheet by the adhesive. Any conventional and well known adhesives can be used for the remoistenable and the wet adhesives, and the adhesive can be applied conventionally by a web offset printing press.

A fold line 24 can be formed in the sheet material if desired for facilitating folding of the sheet as will be described hereinafter. The fold line is positioned between the remoistenable adhesive 23 and the ends of the U-shaped bar of wet adhesive 21.

Figure 2:
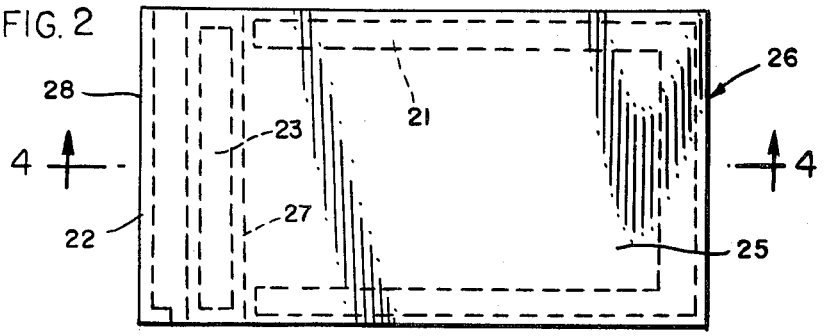
FIG. 2 is a top plan view of the completed envelope insert.

FIG. 2 shows a second rectangular sheet 25 secured to the first sheet 15 by the wet adhesive bars 21 and 22 to form an envelope insert 26. The second sheet is not secured in the area of the remoistenable adhesive 23. The second sheet is coextensive with the first sheet, and the envelope insert therefore has a uniform double thickness of sheet material throughout its area. Before the second sheet is secured to the first sheet, a perforation line 27 is formed in the second sheet. The perforation line 27 is located on the second sheet so that it lies between the remoistenable adhesive 23 and the ends of the wet adhesive 21. If the first sheet is provided with the fold line 24, the perforation line 27 is positioned so that it lies over or slightly to the right of the fold line.

The two sheets of the envelope insert 26 are adhesively secured together around substantially the entire peripheries thereof. The only areas in which the peripheries are not secured are in the relatively short spaces between the ends of the U-shaped adhesive bar 21 and the adhesive bar 22. If desired, the lengths of these unsecured spaces can be reduced by extending the ends of adhesive bar 22 toward the perforation line 20 of the first sheet as at 22*a* (FIG. 1).

Since the envelope insert has a uniform thickness and since substantially the entire peripheries of the two sheets of the envelope insert are secured together, a plurality of envelope inserts can be stacked evenly without the stack tilting in one direction or another. The stacked envelopes can therefore be fed without difficulty by conventional automatic feeding equipment into the space between adjacent pages of a magazine as the magazine is being assembled and bound. The end edge 28 of the envelope insert which is formed by the end 16 of the first sheet and the corresponding end of the second sheet is fed into the area of the magazine pages which is to be bound so that the envelope insert is bound into the magazine in the area between the end edge of the insert and the perforation line 20 on the first sheet 15. This area forms an attaching portion 29 for the envelope insert and should be wide enough so that the perforation line 20 is not within the binding of the magazine. If desired, the width of the attaching portion can be substantially wider than this mimimum width in order to provide room for printed matter which will remain bound into the magazine after the envelope is detached from the attaching portion. Since the two sheets are adhesively secured together at the end edge 28 of the insert, which is the leading edge as the insert is inserted between the magazine pages, the sheets will not flutter or separate during insertion.

The machinery and method for feeding the envelope inserts between the magazine pages and for binding the magazine pages is conventional and need not be described herein. The word "magazine" as used herein is not meant to be limited to soft cover publications and is meant to include any publication in which the pages are bound together, for example, books, journals, periodicals, etc.

Figure 3:
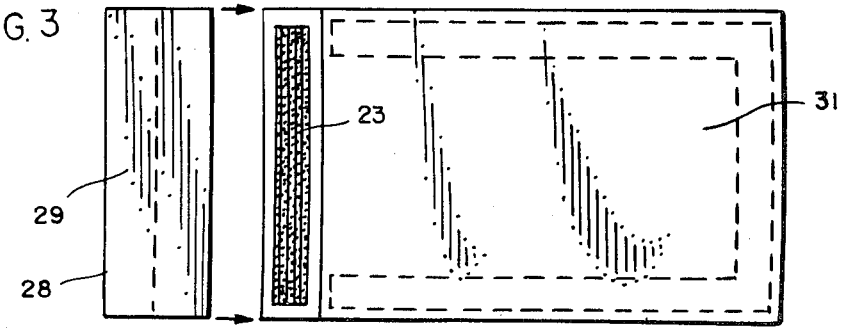
FIG. 3 is a top plan view showing the envelope being detached from the attaching portion of the insert.
Figure 4:
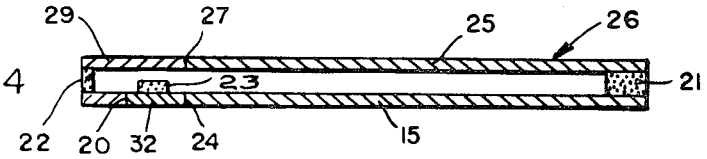
FIG. 4 is a sectional view taken along the line 4—4 of FIG. 2.
Figure 5:
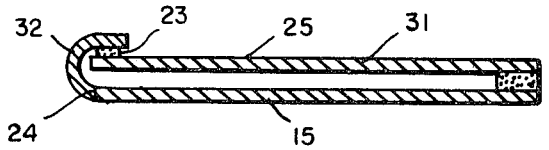
FIG. 5 is a sectional view showing the detached envelope sealed by folding and adhesively securing the flap portion.

The envelope insert can be printed with advertising and promotional material and with instruction for detaching and using the envelope. The magazine reader grasps the end of the envelope insert which extends away from the magazine binding and the attaching portion 29 which is secured within the binding and detaches the two sheets 15 and 25 of the envelope insert from the attaching portion along the perforation lines 20 and 27, respectively, to provide an envelope 31 (FIG. 3). The sheets can be separated along the two perforation lines even though the perforation lines are offset from each other as shown in FIG. 4. Since the perforation lines are offset, the lower sheet 15 will extend beyond the upper sheet 25 to form a flap portion 32 which carries the remoistenable adhesive 23. The printed instructions on the envelope can instruct the user to insert money, an entry blank, etc. into the envelope, moisten the remoistenable adhesive 23, fold the flap along the fold line 24, and adhesively secure the flap to the top sheet 25 to seal the envelope. The fold line 24 can be omitted if desired, but it facilitates folding the flap in the proper place. The sealed envelope can then be mailed to the address which is preprinted on the envelope.

The attaching portion 29 of the envelope insert remains bound in the magazine, and this attaching portion can be made wider if desired so that advertising material can be printed on the attaching portion and remain in the magazine for subsequent readers.

Figure 6:
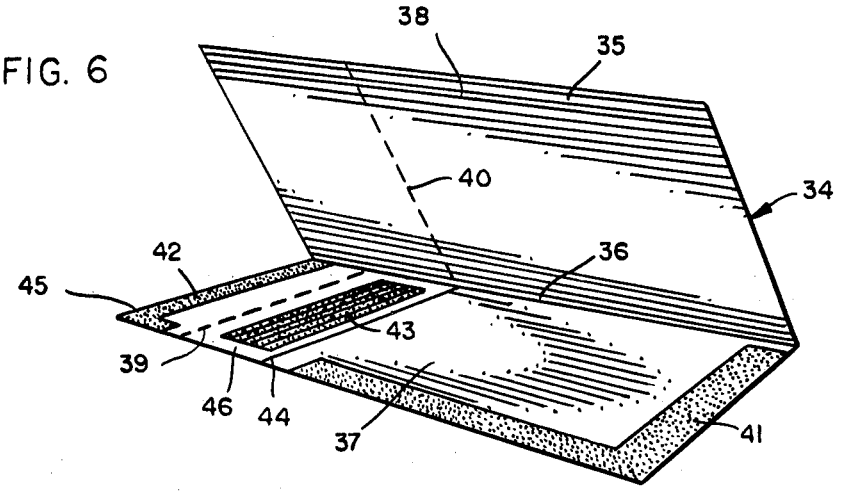
FIG. 6 is a perspective view of another envelope insert being formed from a single sheet which is folded into double thickness.
Figure 7:
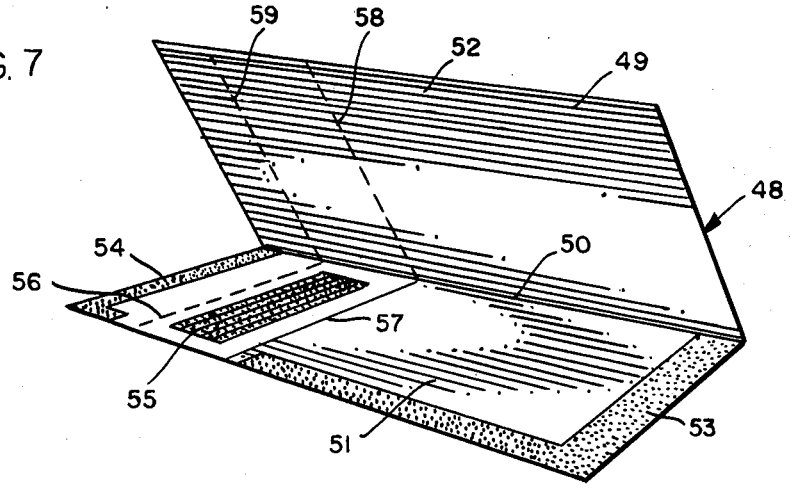
FIG. 7 is a perspective view similar to FIG. 6 of another embodiment of an envelope insert.
Figure 8:
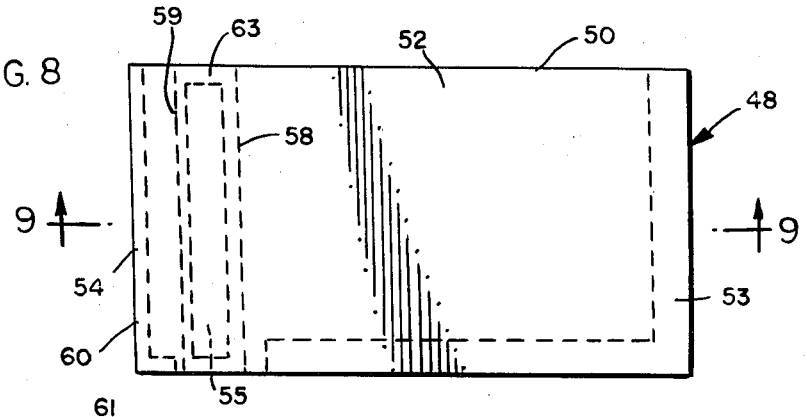
FIG. 8 is a top plan view of the envelope insert of FIG. 7 after the sheet is folded and secured.

FIG. 6 illustrates an envelope insert 34 which is similar to the envelope insert of FIGS. 1–5 except that it is formed from a single sheet 35 which is folded along a fold line 36 to provide coextensive first and second sheet portions 37 and 38. Before folding the first and second sheet portions are provided with perforation lines 39 and 40, respectively, and wet adhesive bars 41 and 42 and a remoistenable adhesive bar 43 are applied to the sheet portion 37. A fold line 44 can be made in the sheet portion 37 between the remoistenable adhesive 43 and the end of the L-shaped wet adhesive bar 41. The folded sheet portions 37 and 38 are adhesively secured by the wet adhesive 41 and 42 to form an envelope insert having a uniform double thickness. The envelope insert is bound into a magazine at the end 45.

The perforation lines 39 and 40 are offset in the same way as the perforation lines 20 and 27 (FIG. 5) to provide a flap portion 46 when the envelope is detached from the attaching portion. In order to facilitate detachment of the envelope, the portion of the fold line 36 between the perforation lines 39 and 40 can also be perforated.

The side of the envelope which is formed by the fold line 36 does not have adhesive between the sheets, and the sealed envelopes can be opened after they reach their destination by an automatic slitting machine which slits the envelope along the fold line.

FIGS. 7–11 illustrate still another embodiment of an envelope insert which is similar to the envelope insert shown in FIG. 6 except that one of the sheet portions is provided with a pair of perforation lines. The envelope insert 48 is provided by a single sheet 49 which is folded along a fold line 50 to provide coextensive first and second sheet portions 51 and 52. The first sheet portion 51 is provided with wet adhesive bars 53 and 54, a remoistenable adhesive bar 55, a perforation line 56, and a fold line 57. The second sheet 52 is provided with a perforation line 58 similar to the perforation line 40 in FIG. 6 and a second perforation line 59 which overlies the perforation line 56 on the lower sheet.

Figure 9:
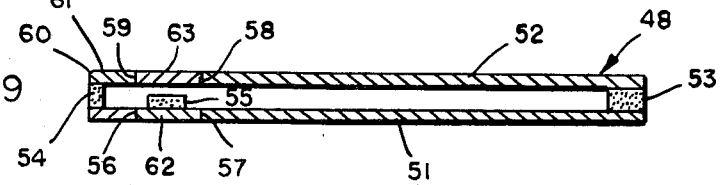
FIG. 9 is a sectional view taken along the line 9—9 of FIG. 8.

Referring to FIG. 9, the end 60 of the envelope insert is bound into the magazine, and an attaching portion 61 is provided between the end 60 and the perforation lines 56 and 59 in the lower and upper sheets. A flap portion 62 is provided between the perforation line 56 and the fold line 57 of the lower sheet, and a tab portion 63, which overlies the flap portion 62, is provided by the upper sheet between the perforation lines 58 and 59.

Figure 10:
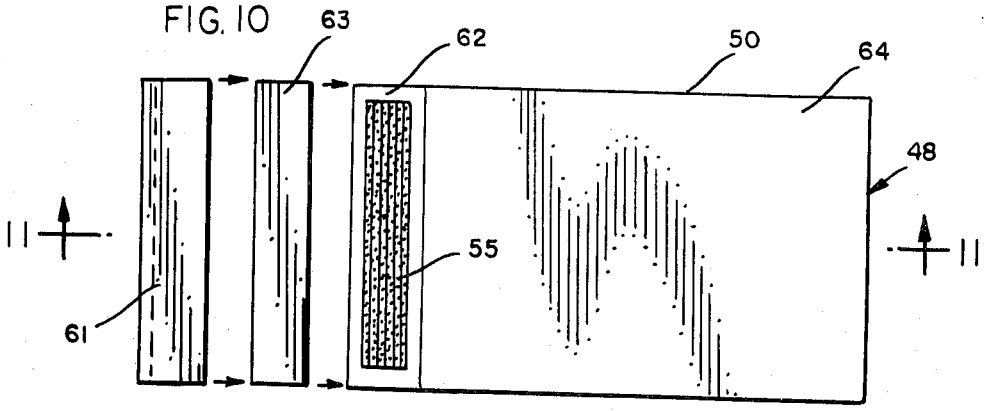
FIG. 10 is a top plan view of the envelope insert of FIG. 8 showing the envelope being detached from the attaching portion.
Figure 11:
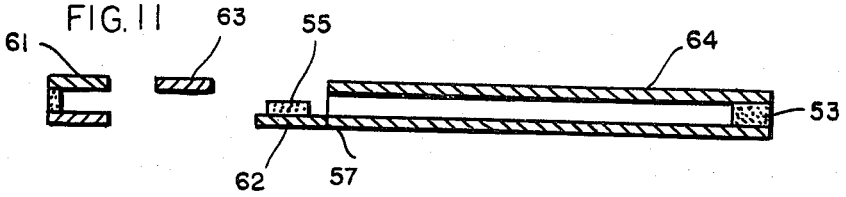
FIG. 11 is a sectional view taken along the line 11—11 of FIG. 10.

FIG. 10 illustrates the envelope insert after the upper and lower sheets are detached from the attaching portion 61 along the perforation lines 59 and 56 to provide an envelope 64. The perforation line 58, which joins the tab portion 63 to the envelope, can provide a relatively weak attachment of the tab portion to the envelope so that after the upper and lower sheets are detached from the attaching portion 61 along the perforation lines 59 and 56, the tab portion is only loosely attached to the envelope. The tab portion can then be easily detached from the envelope as shown in FIG. 11. As described previously with respect to the envelope insert shown in FIG. 6, the fold line 50 between the perforation lines 58 and 59 on the upper sheet can be perforated to facilitate detachment of the tab portion.

Figure 12:
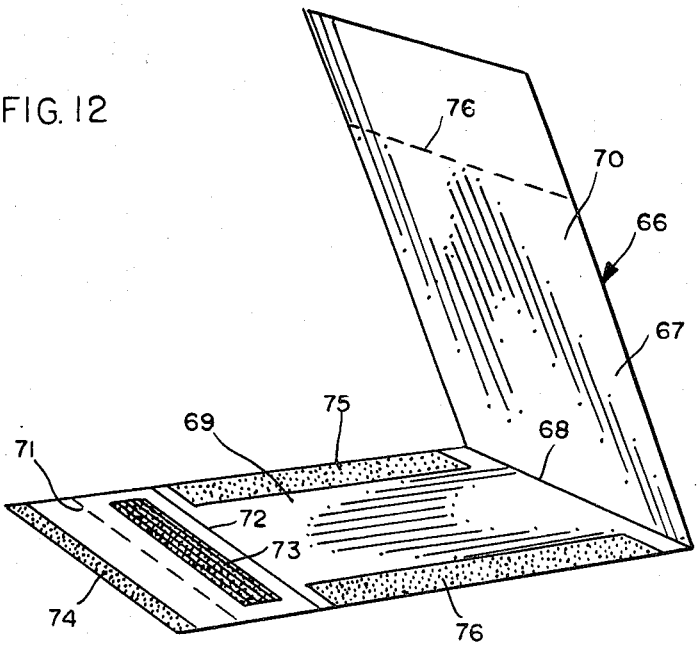
FIG. 12 is a perspective view of still another embodiment of an envelope insert which is formed from a single sheet which is folded into double thickness.

Another embodiment of an envelope insert 66 is illustrated in FIG. 12. A sheet 67 is folded along a transverse fold line 68 to provide first and second sheets 69 and 70. The sheet 69 is provided with a perforation line 71, and a fold line 72, a bar of remoistenable adhesive 73 is applied between the perforation line and the fold line, and wet adhesive bars 74, 75, and 76 are applied adjacent the free edges of the sheet 69.

The sheet 70 is provided with a perforation line 76 which is positioned to lie between the remoistenable adhesive 73 and the ends of the wet adhesive bars 75 and 76 when the upper and lower sheets are folded together along the fold line 68.

The completed envelope insert 66 will be similar to the envelope insert 26 illustrated in FIG. 4 except that the two sheets of the insert will be joined by the fold line 68 along one set of short edges thereof. The envelope is detached in the manner previously described, and a sealed envelope can be opened by slitting the envelope adjacent the fold line 68.

While in the foregoing specification detailed descriptions of specific embodiments of the invention were set forth for the purpose of illustration, it will be understood that many of the details hereingiven may be varied considerably by those skilled in the art without departing from the spirit and scope of the invention.

I claim:

1. A method of inserting an envelope construction in a magazine and removing the envelope construction from the magazine comprising the steps of:

superposing first and second sheets and securing the sheets together to provide an envelope insert, each of said sheets having pair of end edges, each end edge of each sheet overlying an end edge of the other sheet whereby said envelope has a constant thickness of only two sheets provided by said pair of sheets between said end edges, one of said sheets having a perforation line spaced from one of the end edges of the sheet and the other of said sheets having a perforation line between said perforation line of said one sheet and the end edge of said other sheet which overlies said one end of said one sheet to provide a flap portion on said other sheet between the perforation line of said other sheet and the perforation line of said one sheet, and adhesive on the flap portion, inserting the first edges of the first and second sheets between pages of a magazine, tearing the first and second sheets along said perforation lines, and folding said flap portion over the first sheet and securing it to the first sheet.

2. The method of claim 1 in which the first sheet has a second perforation line overlying the perforation line of the second sheet to provide a tab portion between the first and second perforation lines of the first sheet and said first sheet is torn along both of the perforation lines of the first sheet to separate the tab portion before the flap portion of the second sheet is folded over the first sheet.

3. The method of claim 1 in which the first and second sheets are superposed by folding a single sheet to provide said first and second sheets.

* * * * *

UNITED STATES PATENT AND TRADEMARK OFFICE

CERTIFICATE OF CORRECTION

PATENT NO. : 4,406,647

DATED : September 27, 1983

INVENTOR(S) : John F. Foffel

It is certified that error appears in the above-identified patent and that said Letters Patent is hereby corrected as shown below:

Col. 6, line 3, insert --a-- after "having".

Signed and Sealed this

*Twenty-second* Day of *November 1983*

[SEAL]

*Attest:*

GERALD J. MOSSINGHOFF

*Attesting Officer*

*Commissioner of Patents and Trademarks*